United States Patent [19]

Bianchetta et al.

[11] 4,327,549

[45] May 4, 1982

[54] CONTROLLED PRESSURE UPSTAGING AND FLOW REDUCTION

[75] Inventors: Donald L. Bianchetta, Coal City; Sammy J. Rhodes, Aurora, both of Ill.

[73] Assignee: Caterpillar Tractor Co., Peoria, Ill.

[21] Appl. No.: 127,152

[22] PCT Filed: Sep. 17, 1979

[86] PCT No.: PCT/US79/00735

§ 371 Date: Sep. 17, 1979

§ 102(e) Date: Sep. 17, 1979

[87] PCT Pub. No.: WO81/00742

PCT Pub. Date: Mar. 19, 1981

[51] Int. Cl.[3] ..... F15B 11/16; F15B 13/06; F16H 39/46

[52] U.S. Cl. ..... 60/426; 60/427; 60/445; 60/468; 60/484; 91/511

[58] Field of Search ..... 60/422, 426, 427, 444, 60/445, 468, 484, 494; 414/669; 91/451, 511, 527; 137/596.12, 596.13, 596.14, 596.15, 596.16, 491

[56] References Cited

U.S. PATENT DOCUMENTS

| | | | |
|---|---|---|---|
| 3,788,401 | 1/1974 | Scheidt et al. | 91/445 X |
| 3,922,855 | 12/1975 | Bridwell | 60/421 |
| 4,020,862 | 5/1977 | Bohnlein et al. | 137/601 |
| 4,024,797 | 5/1977 | Johnson | 91/451 X |
| 4,030,623 | 6/1977 | Bridwell et al. | 60/421 X |
| 4,107,924 | 8/1978 | Dezelan | 60/445 |
| 4,123,907 | 11/1978 | Bianchetta et al. | 60/445 |

*Primary Examiner*—Irwin C. Cohen
*Attorney, Agent, or Firm*—Phillips, Moore, Weissenberger, Lempio and Majestic

[57] ABSTRACT

An improvement is disclosed in a hydraulic system (10) having a variable displacement pump (12) and being capable of delivering pressurized fluid from the pump (12) to selectively engage at least three work circuits (18) with a first (20) of the circuits (18) being normally operable up to a first pressure and a second (22) of the circuits (18) being normally operable up to a second and lower pressure. The improvement comprises circuitry (80, 92, 94, 98, 108, 120, 122, 124, 126) for selectively operating a third (24) of the circuits (18) at one of the first or second pressures or at an upstaged pressure which exceeds the first pressure and circuitry (128) for reducing the displacement of the pump (12) in response to the third circuit (24) being operated at the upstaged pressure. Such upstaged pressure is available in a controlled manner for working against particularly heavy loads. Thus, a third and higher operating level is added to a system which already operates at at least two pressure levels.

8 Claims, 1 Drawing Figure

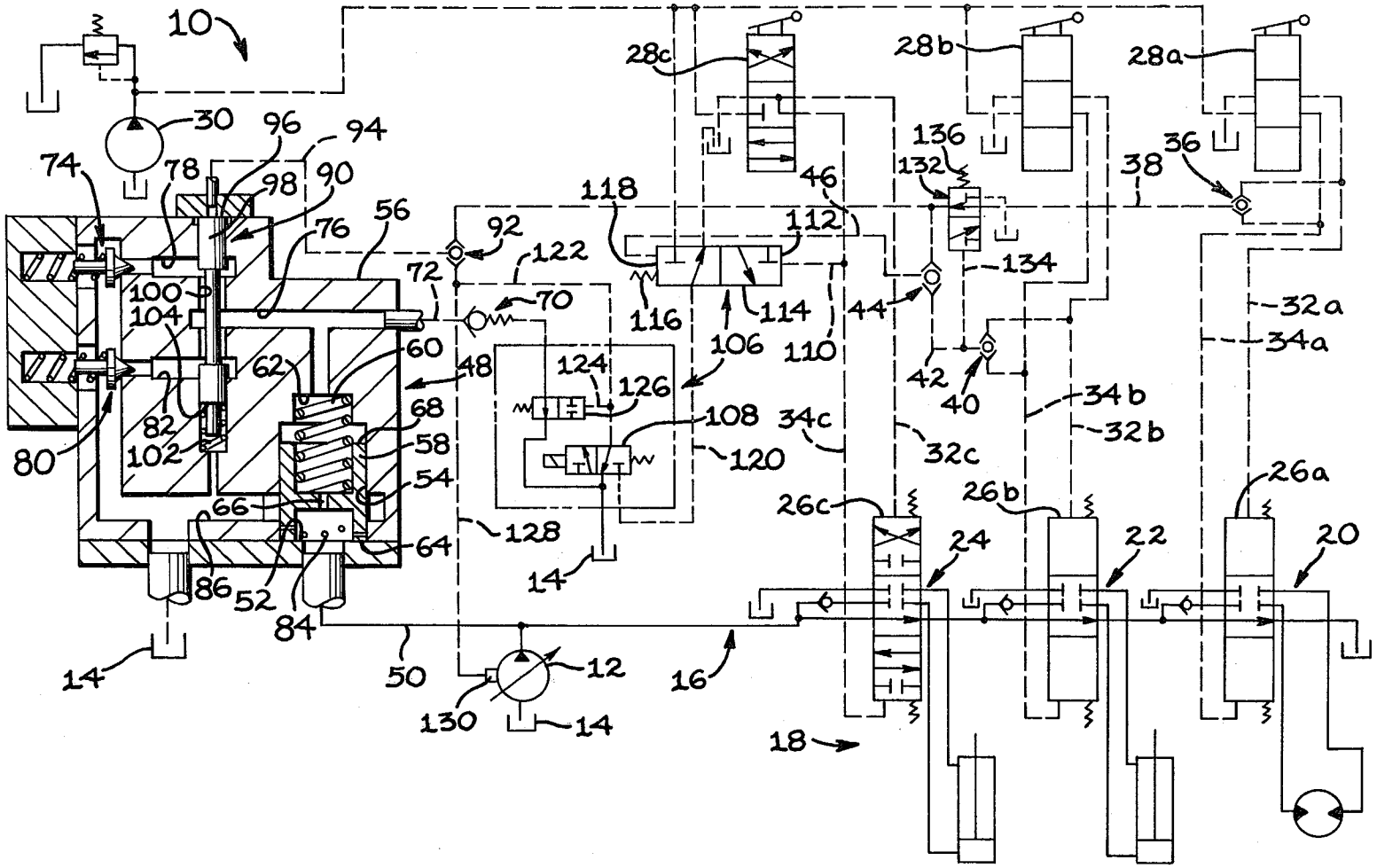
10
12
14
16
18
20
22
24
26a
26b
26c
28a
28b
28c
30
32a
32b
32c
34a
34b
34c
36
38
40
42
44
46
48
50
52
54
56
58
60
62
64
66
68
70
72
74
76
78
80
82
84
86
90
92
94
96
98
100
102
104
106
108
110
112
114
116
118
120
122
124
126
128
130
132
134
136

CONTROLLED PRESSURE UPSTAGING AND FLOW REDUCTION

DESCRIPTION

1. Technical Field

This invention relates to a control system which will allow upstaging of one of a plurality of working circuits fed from a variable displacement pump with concomitant flow reduction.

2. Background Art

A number of vehicles have a plurality of work circuits each supplied in interrupted series or in parallel from a single pressure compensated variable displacement pump. It is known to have some of the work circuits operable at higher pressures than other of the work circuits. For example, the track drive of an excavator may be required to operate at higher pressure than the hydraulic motor which controls the stick or the boom. To accomplish this, the prior art has provided hydraulic control circuitry which will supply a higher pressure, and at times a lower flow rate as well, to a track drive working circuit and a relatively lower pressure to a stick motor or a boom motor. U.S. Pat. No. 4,107,924, issued Aug. 22, 1978 to J. E. Dezelin illustrates a hydraulic circuit for an earthworking vehicle having such characteristics.

In certain circumstances, it is desirable for an operator to be able to supply additional pressure to one of the hydraulic motors, for example, to the boom motor of an excavator when the boom is being raised. In fact, in such a situation it is desirable to be able to supply a higher pressure to the boom motor than is normally supplied even to the track drive. While such a capability has been available with systems which normally operate at only a single pressure level, for example, as shown in U.S. Pat. No. 4,123,907, issued Nov. 7, 1978 to D. L. Bianchetta, et al., it has not been available in a hydraulic system which has work circuits which already operate at two different pressure levels. Further, such pressure control circuitry as is known to the prior art for raising the pressure and lowering the flow rate from a variable displacement pump to a hydraulic circuit which has a work circuit normally operating at only a single pressure range, is not readily adaptable to more complex systems which normally have a hydraulic circuit supplying working circuits which operate at two different pressure ranges.

It therefore follows that it would be advantageous to be able to selectively provide an upstage pressure in one of at least three work circuits of a hydraulic system, wherein the work circuits of the system normally operate in at least two different pressure ranges. It would be further advantageous if such could be accomplished along with a concomitant reduction in pump displacement (output flow), so that during upstaged pressure operation various components, e.g., the boom, being moved would not be overstrained and possibly damaged. A further advantage would be obtained if all of the above could be accomplished while protecting the relatively lower pressure operating work circuits of the system from the upstaged pressure. Still further, it would be advantageous if the above set out operation were accomplished with safety features built in so that operator error could not lead to improper application of excessive pressure to any of the work circuits.

DISCLOSURE OF INVENTION

The present invention is directed to overcoming one or more of the problems as set forth above.

According to one aspect of the present invention, an improvement is provided in a hydraulic system having a variable displacement pump and means for delivering pressurized fluid from the pump to selectively engage at least three work circuits, a first of the circuits being normally operable up to a first pressure and a second of the circuits being normally operable up to a second pressure which is less than the first pressure. The improvement of the invention comprises means for selectively operating a third of the circuits at an upstaged pressure which exceeds the first pressure.

BRIEF DESCRIPTION OF DRAWING

The single FIGURE of the drawing is a diagrammatic view, partially in section, of a hydraulic circuit which includes an improvement in accordance with an embodiment of the present invention.

BEST MODE FOR CARRYING OUT THE INVENTION

Adverting to the FIGURE, there is shown therein a hydraulic system 10 which is particularly adapted for use with an earthworking vehicle such as an excavator. The hydraulic system 10 includes a conventional pressure compensated variable displacement pump 12 for pumping hydraulic fluid from a sump via pressurized fluid delivery means 16 to selectively engage at least three work circuits 18. In the embodiment illustrated, the three work circuits 18 are a first work circuit 20, a second work circuit 22 and a third work circuit 24.

In a manner which will shortly become apparent, the first work circuit 20 is normally operable up to a first pressure, e.g., 28,000 kPa (4,061 psi) and the second work circuit 22 is normally operable up to a second pressure, e.g., 25,000 kPa (3,626 psi), which is less than the first pressure. The pump 12 conventionally internally adjusts displacement dependent upon its output pressure. The first work circuit 20 might typically be a track drive circuit of an excavator the second circuit 22 might be a stick control circuit and the third circuit 24 might be a boom control circuit.

The pressurized fluid delivery means 16 delivers the fluid in interrupted series flow to main control valves *26c*, *26b* and *26a*, respectively of work circuits 24, 22 and 20. That is, the valve *26c* controls flow therethrough to the valve *26b*, which in turn controls flow therethrough to the valve *26a*. Hence, even if the valve *26c* is partially shifted downwardly or upwardly, flow still passes therethrough to the valve *26b*, and therethrough to the valve *26a*.

In the embodiment illustrated, the main control valves *26a*, *26b* and *26c* are controlled respectively by pilot control valves *28a*, *28b* and *28c* which receive pressurized fluid flow from a pilot pump 30. When flow from pilot pump 30 is being supplied via pilot control valve *28a* to first work circuit 20, either line *32a* or line *34a* is pressurized. The pressure of the higher pressure of lines *32a* and *34a* is supplied by a resolver 36 to a pressure control line 38. This pressure is later utilized, in a manner which will become apparent, for limiting the pressure delivered by the pressurized fluid delivery means 16 to the work circuits 20, 22 and 24.

When the pilot control valve *28b* is operated, either line *32b* or line *34b* is pressurized. A resolver 40 delivers the higher of these pressures to a conduit 42. The pressure in the conduit 42 and the pressure in the pressure control line 38 are both fed to a resolver 44. The higher of these pressures is delivered to an upstaged pressure blocking conduit 46 and is utilized in a manner which will be explained below.

When the pilot control valve 28c is operated, either line 32c or line 34c is pressurized. Line 34c is pressurized during boom lifting operation.

In normal (nonupstaged) operation, pressure relief valve circuitry 48 limits the pressure supplied by the pressurized fluid delivery means 16. Fluid from the pump 12 passes into a main conduit 50 from whence it flows to a first end 52 of a bore 54 in a body 56. A main dump spool 58 sits in reciprocal relationship within the bore 54. A spring 60 acts between a second end 62 of the bore 54 and the spool 58. Thus, the spring 60 serves as means for biasing a first end 64 of the spool 58 into blocking relation with the first end 52 of the bore 54. A restricted orifice 66 communicates the first end 64 of the spool 58 with a second end 68 thereof. As pressure builds up in the main conduit 50, pressurized fluid passes via the restricted orifice 66 through the dump spool 58. Thereby, a similar pressure builds up at the second end 62 of the bore 54.

A first relief valve 70, e.g., a poppet relief valve, is provided which is set to open at the first pressure (e.g., 28,000 kPa). The first relief valve 70 communicates via a conduit 72 with the second end 62 of the bore 54. Thus, the first relief valve 70 is exposed to the pressure in the main conduit 50. The first relief valve 70 thereby serves as a first pilot stage of the main dump spool 58.

A second relief valve 74, e.g., a poppet relief valve, is set to open at the second pressure (e.g., 25,000kPa). The second relief valve 74 communicates with the second end 62 of the bore 54 via a conduit 76 and a continuation conduit 78. The second relief valve 74 thereby serves as a second pilot stage of the main relief dump spool 58.

An upstaged pressure (e.g., 31,000 kPa or 4,496 psi) opening relief valve 80, e.g., a poppet relief valve, communicates with the second end 62 of the bore 54 via the conduit 76 and a continuation conduit 82. The upstaged pressure opening relief valve 80 thereby serves as an upstaged pilot stage of the main relief dump spool (58).

When either the first relief valve 70, the second relief valve 74, or the upstaged pressure opening relief valve 80 is opened by an appropriate pressure being exerted thereupon, a pressure differential is created across the dump spool 58 which lifts it upwardly in the drawing against the force of the spring 60. A plurality of holes 84 through the side of the dump spool 58 adjacent the first end 64 thereof and a conduit 86 then serve as means for communicating the first end 52 of the bore 54 with the sump 14 responsive to upward movement of dump spool 58.

Means 90 are provided for blocking off communication of the second end 62 of the bore 54 with the second check valve 74 responsive to engagement of the first circuit 20. When the first circuit 20 is engaged, pressure from the pressure control line 38 is delivered via a resolver 92 and a pressure delivery conduit 94 to a first end 96 of a blocking spool 98 which fits in a bore 100. A spring 102 acts against a second end 104 of the blocking spool 98 to force it upwardly into the position shown in the drawing. When pressure (pilot pressure) is applied in the pressure delivery conduit 94, this forces the blocking spool 98 downwardly thus blocking off the continuation conduit 78. When the continuation conduit 78 is blocked off, this prevents pressure from the second end 62 of the bore 54 from being applied to the second relief valve 74. Thus, the dump spool 58 does not dump pressure from the main conduit 50 at the lower pressure, i.e., at the aforementioned second pressure (e.g. 25,000 kPa). Instead, when the pressure in the main conduit 50 reaches the first pressure (e.g., 28,000 kPa), the first relief valve 70 opens which causes the dump spool 58 to limit the pressure delivered by the pump 12 to the first pressure.

Means 106 are provided for blocking flow from the second end 62 of the bore 54 past both the first relief valve 70 and the second relief valve 74 responsive to engagement of the third circuit 24 at the upstaged pressure. Referring to the drawing, to place the third circuit 24 in the upstage pressure mode of operation, the pilot control valve 28c is shifted upwardly which in turn shifts the main control valve 26c upwardly. Further, a solenoid actuated valve 108 is shifted rightwardly from the position shown, on operator activation of a switch. The pressure in line 34c is delivered via a branch conduit 110 against a first side 112 of a two position valve 114. If either the first circuit 20 or the second circuit 22 is operating, pressure in the upstage pressure blocking conduit 46 opposes the pressure in the branch conduit 110 and the two position valve 114 remains in the position shown, due to the biasing of a spring 116 and the pressure in the blocking conduit 46 which acts against a second side 118 thereof.

So long as neither the first circuit 20 nor the second circuit 22 is operating, there is no pressure in the upstage pressure blocking conduit 46. In this situation, the pressure in the branch conduit 110 forces the two position valve 114 leftwardly. This delivers pilot pressure via a conduit 120 to the solenoid actuated valve 108. With the solenoid actuated valve 108 in its actuated position, i.e., shifted rightwardly, flow continues from the conduit 120 via a conduit 122 to the resolver 92. Since there is now no pressure in the pressure control line 38 (as the first circuit 20 is not operating), the pressure from the conduit 122 is supplied via the resolver 92 to the pressure delivery conduit 94. In accordance with the previously described mode of operation, this forces the blocking spool 98 downwardly and blocks off the second relief valve 74. Pressure in the conduit 122 also acts via a branch conduit 124 against an auxiliary blocking valve 126 and forces the auxiliary blocking valve 126 leftwardly in the drawing. This blocks off any possibility of flow past the first relief valve 70. Thus, the first relief valve 70 is likewise incapacitated. Flow can still, however, occur from the second end 62 of the bore 54 to the upstage pressure opening relief valve 80. And, when pressure reaches its upstage value (e.g., 31,000 kPa), the upstage relief valve 80 opens, whereby the dump spool 58 opens, thereby regulating pressure in the main conduit 50 to be the upstage pressure.

Pressure in the conduit 122 is also supplied via a displacement control conduit 128 to a conventional pump displacement control 130. Responsive to the pressure in the displacement control conduit 128, the variable displacement pump 12 shifts to a lower displacement and thereby supplies pressurized fluid at a lower flow rate. This assures that when upstaged pressure operation is taking place in the third circuit 24, it is taking place at a relatively slow rate so that the various structural components being moved by third circuit 24 are not strained beyond their limits.

It will be noted that a two position valve 132 is positioned in the pressure control line 38. The two position valve 132 serves to assure that when the second circuit 22 is engaged, the pressure delivered by the pump 12 to the main conduit 50 is limited to the second pressure. If, for example, the first circuit 20 is engaged, the main line 50 will be limited to the first pressure (e.g., 28,000 kPa) as has been previously explained. If the pilot control valve **28*b* is now moved to engage the second circuit 22, pressure from the conduit 42 is applied via a branch conduit 134 against the two position valve 132, in opposition to the biasing thereof by a spring 136. The pressure in the branch conduit 134 overcomes the force of the spring 136 and forces the two position valve 132 upwardly. This blocks off pressure from the pressure control line 38 and stops it from reaching the pressure delivery conduit 94. As a result, the blocking spool 98 moves upwardly and pressure begins to be delivered again to the continuation conduit 78 and the second check valve 74. Since the second check valve 74 is set at the second pressure (e.g., 25,000 kPa), which is lower than the first pressure, the pressure at the mainline 50 is limited to the setting of the second relief valve 74. In this manner, it is assured that the second circuit 22** can not be exposed to a pressure over that for which it is normally designed.

It follows that the solenoid actuated valve 108, in combination with the two position valve 114 and various conduits as previously described, serves as means for selectively operating the third circuit 24 at an upstaged pressure which exceeds the first pressure. Further, the displacement control conduit 128 then serves as means for reducing the displacement of the pump 12, in response to the third circuit 24 being operated at the upstaged pressure.

It also follows that the two position valve 114 serves as means for preventing operation of the third circuit 24 at the upstaged pressure when either the first circuit 20 or the second circuit 22 is engaged. That is, whenever there is pressure in the upstaged pressure blocking conduit 46, which corresponds to either the first circuit 20 or the second circuit 22 being engaged, the two position valve 114 is blocked, thus preventing upstaged operation of the third circuit 24.

Furthermore, the third circuit 24 is normally operated only up to a third pressure, which is generally no greater than the aforementioned first pressure and usually no greater than the aforementioned second pressure. That is, the pilot control valve **28*c* motivates the main control valve 26*c*, which receives pressurized fluid at a pressure determined by either first relief valve 70 or second relief valve 74 in the absence of shifting of solenoid valve 108 rightwardly and shifting of main control valve 26*c* upwardly, to place third circuit 24 in the upstaged mode of operation. If it is desired to limit operation of the third circuit 24 to the second pressure, this can be accomplished by duplicating two position valve 132 or providing an appropriate resolver from line 32*c* and from conduit 42 to branch conduit 134**.

It should be noted that when the first circuit 20 is engaged, the resulting pressure in the upstaged pressure blocking conduit 46 assures that the pressure delivered by the pump 12 to the main conduit 50 is reduced to the first pressure. It should further be noted that when the second circuit 22 is engaged, this overrides the pressure reducing due to engagement of the first circuit 20 and assures that the pressure must be reduced further to the second pressure.

It should also be noted that when either the first circuit 20 or the second circuit 22 is engaged, the pump displacement reduction is terminated since there is no signal in the displacement control conduit 128, due to the blockage of the two position valve 114.

INDUSTRIAL APPLICABILITY

The aforementioned and described improved hydraulic system is particularly useful with an excavator and wherein the first circuit is a track drive circuit, the second circuit is a stick control circuit and the third circuit is a boom control circuit. Further, in such an excavator the upstaged operation of the boom control circuit is normally selectable only on boom raising operation.

We claim:

1. In a hydraulic system (10) having a variable displacement pump (12), a plurality of fluid work circuits (18) including first (20), second (22) and third (24) fluid work circuits, means (16) for delivering pressurized fluid from said pump (12) to selectively engage said first (20), second (22) and third (24) work circuits and pressure relief means (70, 74) for normally limiting each of (a) said first of said circuits (20) to normally operate up to a first pressure level, (b) said second (22) of said circuits (18) to normally operate up to a second pressure level which is less than said first pressure level and (c) said third (24) of said circuits (18) to normally operate up to a third pressure level which is no greater than said first pressure level, the improvement comprising:

means (80, 92, 94, 98, 108, 120, 122, 124, 126) for selectively operating said third circuit (24) at an upstaged pressure level which exceeds said first pressure level: and means (114) for preventing operation of said third circuit (24) at said upstaged pressure level in response to engagement of either one of said first circuit (20) and said second circuit (22).

2. The improvement as in claim 1, further including:

means (128) for reducing the displacement of said pump (12) in response to said third circuit (24) being operated at said upstaged pressure level.

3. The improvement as in claim 1, further including:

means (132, 134) for limiting the pressure level of said pressurized fluid delivery means (16) to said second pressure level in response to engagement of said second circuit (22).

4. The improvement as in claim 2, further includng:

means (42, 44) for terminating said reducing of said pump displacement in response to engagement of said second circuit (22).

5. The improvement as in claim 2, further includng:

means (38, 44, 46) for limiting the pressure level of said pressurized fluid delivery means (16) to said first pressure level and for terminating said reducing of said pump displacement in response to engagement of said first circuit (20).

6. The improvement as in claim 1, wherein said hydraulic system (10) is for an excavator, said first circuit (20) is a track drive circuit, said second circuit (22) is a stick control circuit, said third circuit (24) is a boom control circuit, and said upstaged operating of said boom control circuit (24) is selectable only on boom raising operation thereof.

7. The improvement as in claim 1, wherein the pressure supplied by said pressurized fluid delivery means (16) is limited by structures including:

a body (56) having a bore (54);

a dump spool (58) in said bore (54);

means (50) for flowing pressurized fluid from said pump (12) to a first end (52) of said bore (54);

means (60) for biasing a first end (64) of said spool (58) into blocking relation with said first end (52) of said bore (54);

a restricted orifice (66) communicating said first end (64) of said spool (58) with a second end (68) of said spool (58);

(wherein said pressure relief means (70, 74) includes a first relief valve (70) adapted to open in response to said second end (62) of said bore (54) being at said first pressure level and a second relief valve (74) adapted to open in response to said second end (62) of said bore (54) being at said second pressure level;

wherein said third circuit selective operating means (80, 92, 94, 98, 108, 120, 124, 126) includes an upstaged pressure opening relief valve (80) adapted to open in response to said second end (62) of said bore (54) being at said upstaged pressure level;

means (86) for communicating said first end (52) of said bore (54) with a sump (14) in response to unblocking of said first end (52) of said bore (54);

means (90) for blocking communication of said second end (62) of said bore (54) with said second relief valve (74) in response to engagement of said first circuit (20); and means (106) for blocking flow from said second end (62) of said bore (54) past said first relief valve (70) and past said second relief valve (74) in response to engagement of said third circuit (24) at said upstaged pressure level.

8. A hydraulic system (10), comprising:

a variable displacement pump (12);

a plurality of fluid work circuits (18) including a first (20), a second (22) and a third (24) fluid work circuit;

means (16) for delivering pressurized fluid from said pump (12) selectively to said first work circuit (20) which is normally operable up to a first pressure level, said second work circuit (22) which is normally operable up to a second pressure level which is less than said first pressure level and said third work circuit (24) which is normally operable up to a third pressure level which is no greater than said first pressure level;

means for selectively operating said third circuit (24) at an upstaged pressure level which exceeds said first pressure level;

a normally closed main relief valve (58) between said sump (14) and said means (16);

a first pilot stage (70) of the main relief valve (58) being adapted to open in response to application thereto of said first pressure level;

a second pilot stage (74) of the main relief valve (58) being adapted to open in response to application thereto of said second pressure level;

an upstaged pilot stage (80) of the main relief valve (58) adapted to open in response to application thereto of said upstaged pressure level;

means (66) for opening said main relief valve (58) in response to opening of any of said pilot stages (70,74,80);

means (90) for preventing opening of said second pilot stage (74) in response to operation of said first circuit (20) at said first pressure level and in response to operating of said third circuit (24) at said upstaged pressure level;

means (10) for preventing opening of said first pilot stage (70) in response to engagement of said third circuit (24) at said upstaged pressure level; and means (114) for preventing operation of said third circuit (24) at said upstaged pressure level in response to engagement of either one of said first circuit (20) and said second circuit (22).

* * * * *